United States Patent [19]

Bahrani

[11] Patent Number: 4,571,924

[45] Date of Patent: Feb. 25, 1986

[54] METHOD AND APPARATUS OF MANUFACTURING POROUS POUCHES CONTAINING GRANULAR PRODUCT

[75] Inventor: Abdul S. Bahrani, Cincinnati, Ohio

[73] Assignee: The Procter & Gamble Company, Cincinnati, Ohio

[21] Appl. No.: 728,070

[22] Filed: Apr. 29, 1985

[51] Int. Cl.[4] ..... B65B 47/00

[52] U.S. Cl. ..... 53/453; 53/454; 53/559; 53/560; 53/579; 141/67

[58] Field of Search ..... 53/427, 432, 453, 454, 53/509, 559, 560, 561, 574, 578, 579; 141/67

[56] References Cited

U.S. PATENT DOCUMENTS

| | | | |
|---|---|---|---|
| 1,950,765 | 3/1934 | Winter | 223/15 |
| 2,073,329 | 3/1937 | Winter | 154/33 |
| 2,470,851 | 5/1949 | Hermanson | 252/93 |
| 2,571,138 | 10/1951 | Irmscher | 99/77.1 |
| 2,769,290 | 11/1956 | Harriman | 53/29 |
| 2,791,324 | 5/1957 | Knoop et al. | 206/47 |
| 2,835,911 | 5/1958 | Mahmarian | 15/131 |
| 2,949,713 | 8/1960 | Vogt | 53/579 X |
| 3,038,282 | 6/1962 | Hansen et al. | 53/560 X |
| 3,208,192 | 9/1965 | Schaefer | 53/453 X |
| 3,426,505 | 2/1969 | Cloud | 53/559 |
| 3,498,019 | 3/1970 | Rait | 53/28 |
| 3,813,848 | 6/1974 | Romagnoli | 53/178 |
| 3,846,569 | 11/1974 | Kaplan | 426/394 |
| 4,005,957 | 2/1977 | Savich | 425/80 |
| 4,259,383 | 3/1981 | Eggensperger et al. | 428/72 |
| 4,262,473 | 4/1981 | Brooke | 53/450 |
| 4,265,070 | 5/1981 | Mainberger | 53/453 X |
| 4,375,447 | 3/1983 | Chung | 264/518 |
| 4,404,787 | 9/1983 | Hazelwood | 53/502 |
| 4,433,783 | 2/1984 | Dickinson | 206/484 |
| 4,437,294 | 3/1984 | Romagnoli | 53/553 |

*Primary Examiner*—John Sipos

*Assistant Examiner*—Steven P. Weihrouch

*Attorney, Agent, or Firm*—Richard C. Witte; John V. Gorman; Ronald J. Snyder

[57] ABSTRACT

A method and apparatus for making a porous laminated sheet product having upper and lower web members connected about their periphery and having at least one compartment formed therein, and containing a predetermined quantity of inner product within such compartment. In a preferred embodiment, the apparatus includes a pouch-forming surface having at least one inner product loading area formed therein which further includes a cavity surrounded by peripheral land areas, a passageway adapted to place the product loading area cavity in fluid communication with a vacuum source such that suction can be selectively applied to the cavity, and one or more apertures formed through the peripheral land areas and adapted to be selectively placed in fluid communication with a source of pressurized air whereby outward air flow can emanate from the peripheral land areas. The preferred process for making the porous pouches includes placing a first porous web of pouch material in contact with the pouch forming surface, depositing a quantity of granular product on the upper surface of the first porous web such that the vacuum source tends to hold the granular product against the upper surface of the first web in the product loading area cavity while the pressurized air tends to keep the granular product from being deposited on the upper surface of the first web in the peripheral land areas, and supplying a second web of pouch material and laminating the lower surface thereof to the upper surface of the first porous web along the peripheral land areas. This process thereby forms one or more porous pouches containing a predetermined quantity of granular product sealed about their periphery.

53 Claims, 9 Drawing Figures

METHOD AND APPARATUS OF MANUFACTURING POROUS POUCHES CONTAINING GRANULAR PRODUCT

TECHNICAL FIELD

This invention relates to a method and apparatus for manufacturing a porous laminated sheet product having at least one compartment formed therein containing an inner product, and, more particularly, to a method and apparatus of manufacturing laminated porous pouches containing granular product and featuring fluid pressure granular product placement.

BACKGROUND ART

Over the years, many methods and apparatuses for manufacturing various bags, pouches and sealed packages have been devised. An example of a method and apparatus for manufacturing tea bags in disclosed in U.S. Pat. No. 4,262,473, which issued to Arthur A. Brooke on Apr. 21, 1981. In the Brooke method, a porous web is formed into a flattened closed tube as a continuous stream of tea product is introduced therewithin. The flattened tube filled with tea product first travels generally horizontally and means are provided to pinch the tube closed at predetermined intervals therealong. The pinching means are adapted to maintain the tube in its pinched condition as the tube is then moved vertically, thereby causing the tea product contained therein to migrate downwardly under gravity creating a voided area immediately below each pinch line. The porous tube is then heat sealed transversely along the voided areas of the tube. Further means are provided to separate the successive sections from the tube to form individual tea bags or groups of such bags.

U.S. Pat. No. 3,498,019, which issued to J. M. Rait on Mar. 3, 1970, also discloses a method and apparatus for forming sealed packages. The Rait sealed packages are formed from thermoplastic material wherein predetermined amounts of product are dosed onto the upper surface of a lower thermoplastic sheet in a predetermined pattern. Thereafter, a second thermoplastic sheet is brought in parallel to the first sheet and the two sheets are heat sealed together by a heated compartmentalized rotating cylinder. The movement of the upper and lower plastic sheets is synchronized with the rotational movement of the heated compartmentalized cylinder such that the compartments on the surface of the cylinder are positioned over the deposited product as the sheets are moved below the rotating cylinder.

A method of packaging predetermined volumes of incoherent product is disclosed in U.S. Pat. No. 3,813,848, which issued on June 4, 1974 to Andrea Romagnoli. The Romagnoli process utilizes a rotary dispensing drum having batching recesses formed therein to deposit predetermined doses of incoherent material onto the upper surface of a moving web of packaging material. A second band of wrapping material is thereafter bonded to the upper surface of the first sheet of material to cover the heaps of product deposited thereon. A similar volumetric batching device is shown in U.S. Pat. No. 4,437,294, which also issued to Andrea Romagnoli on Mar. 20, 1984. U.S. Pat. No. 4,404,787, which issued to G. Hazelwood on Sept. 20, 1983, similarly discloses a machine for packaging tea which includes a rotary dispensing drum which deposits tea in predetermined piles on a lower web and, thereafter, seals an upper web of packaging material onto the upper surface of the lower web about the perimeter of each pile. Individual tea bags are then separated from one another by a cutter.

A method of manufacturing an infusion package with an expandable bottom is taught in U.S. Pat. No. 2,571,138, which issued to H. O. Irmscher on Oct. 16, 1951. The Irmscher method includes folding a porous sheet of web material in half, then clamping the two parallel open sides by a pair of pincher jaws thereby creating a bag-like structure having an open top. A measured quantity of infusion product is then placed in the bag through its open top, and, thereafter, the top opening and the transversely extending side portions are heat sealed to form a closed pouch. A tag and string handle are then added to each bag by a separate operation.

A soap powder package heat sealed about its periphery and including additional heat seals delineating predetermined compartments in such package is shown in U.S. Pat. No. 4,433,783, which issued to R. H. Dickinson on Feb. 28, 1984. The Dickinson package includes a pair of cooperating front and rear heat sealable panels arranged on opposite sides of the soap powder which is spread out as a layer therebetween. The panels are heat sealed along their peripheral edges to form a storage compartment for the soap, and, thereafter, a plurality of additional heat seals are made to divide the storage compartment into a series of subcompartments to minimize shifting of the powder stored therewithin during handling. Dickinson teaches that the additional heat seals within the storage compartment can be made despite the presence of soap powder interposed between the heat sealable panels.

A method and apparatus for making sanitary napkins or the like is disclosed in U.S. Pat. No. 2,073,329, which issued to C. P. Winter on Mar. 9, 1937. In the Winter process a rotatable wheel having screened inlets connected to a source of suction collects cotton fibers in a predetermined pattern and deposits those cotton fibers on a gauze web moving along the bottom edge of the first rotating wheel. The gauze web is then moved to a second rotating wheel, and as the gauze web is rotated about the periphery of the second rotating wheel, additional loose absorbent material is forced in a predetermined pattern onto the previously deposited loose cotton patches to selectively build up a wad or pad on the web. The gauze web is thereafter forwarded with its built up pads for further processing.

Despite the great amount of prior work done with regard to improving the process of making laminated products having inner compartments containing quantities of inner product, as evidenced by some of the above-described patents, there remain problems in efficiently producing such laminated products with high quality and at high speeds on automatic equipment. For example, with equipment and methods currently available in the industry, accurate high speed dosing of predetermined amounts of granular material is messy, unreliable and relatively slow.

DISCLOSURE OF THE INVENTION

It is an object of this invention to obviate the above-described problems.

It is another object of the present invention to provide a more efficient apparatus and method for making compartmentalized, laminated sheet products having upper and lower porous web members connected about their periphery and containing predetermined pattern and quantity of product therewithin.

It is also an object of the present invention to provide an apparatus and process to more efficiently maintain the periphery of compartments within such upper and lower porous web members clear of contained product to facilitate the connection of such porous web members while making porous pouches containing a predetermined pattern and quantity of product therewithin.

It is another object of the present invention to provide a more efficient apparatus and method for making porous pouches having upper and lower web members connected about their periphery and containing a predetermined dose of granular product.

In accordance with a particular embodiment of the present invention, there is provided an apparatus for making porous pouches having upper and lower porous web members connected about their periphery and containing a predetermined dose of granular product. The apparatus includes a pouch-forming surface which has at least one product loading area formed therein which further includes a cavity surrounded by peripheral land areas, a passageway adapted to place the product loading area cavity in fluid communication with a vacuum source so that suction can be selectively applied to the cavity, and one or more apertures formed through the peripheral land areas adapted to be selectively placed in fluid communication with a source of pressurized gas, whereby outward air flow can emanate from the peripheral land areas. The process includes placing a first porous web of pouch material in contact with the pouch forming surface, depositing a quantity of granular product on the upper surface of the first porous web such that the vacuum source tends to hold the granular product against the upper surface of the first porous web in the loading area cavity, while pressurized gas tends to keep the granular product from being deposited on the first porous web in the peripheral land areas, and supplying a second web of pouch material and laminating the lower surface of the second web to the upper surface of the first web along the peripheral land areas. The process thereby forms one or more porous pouches sealed about their periphery.

BRIEF DESCRIPTION OF THE DRAWINGS

While the specification concludes with claims particularly pointing out and distinctly claiming the present invention, it is believed that the same will be better understood from the following description taken in conjunction with the accompanying drawings:

DETAILED DESCRIPTION

Figure 1:
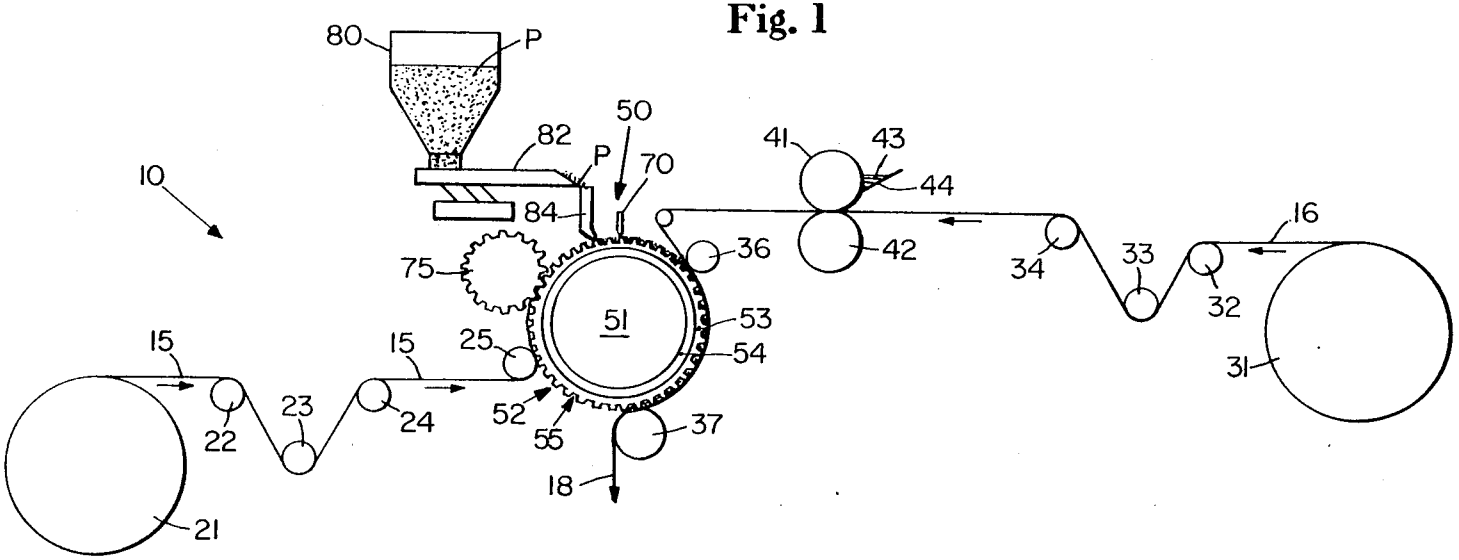
FIG. 1 is a schematic diagram illustrating an embodiment of the method for forming a porous laminated sheet product of the subject invention.
Figure 2:
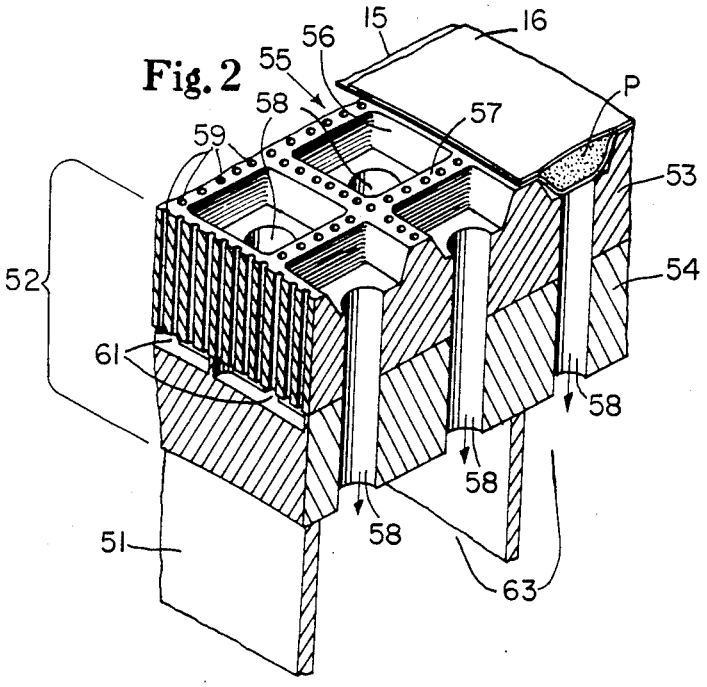
FIG. 2 is a pictorial perspective enlarged cross-sectional view of a portion of the compartment-forming surface of the subject invention including a portion of a porous laminated sheet product formed thereon.

Referring now to the drawings in detail, wherein like numerals indicate the same elements throughout the views, FIGS. 1 and 2 illustrate the details of a method and apparatus for making a porous laminated sheet product having upper and lower web members connected about their periphery and having at least one compartment formed therein. The compartment formed within the porous laminated sheet product contains a predetermined quantity of inner product therewithin. In particular, FIG. 1 schematically illustrates a continuous process 10 for forming laminated sheet product 18 wherein upper web member 16 and lower web member 15 are continuously fed to a compartment-forming apparatus 50. Compartment-forming apparatus 50 further comprises a mold-depositing core 51, and an outer rotatable mold-depositing drum 52 having an inner portion 54 and an outer compartment-forming surface 53.

Outer compartment-forming surface 53 is shown as having at least one inner product loading area 55 formed therein comprising a cavity 56 surrounded by peripheral land areas 57. A plurality of cavities 56 are illustrated as being substantially square in configuration, however, the shape of cavities 56 and peripheral land areas 57 could be formed in any desired shape to correspond to the shape of the compartment or compartments required in the laminated sheet product. A passageway 58 is adapted to place the inner product loading area 55 in fluid communication with a source of vacuum (not shown) such that suction can be selectively applied to cavity 56, as will be discussed in greater detail below. Passageway 58 is shown as a single bore, however, any number of passageways can be utilized to place the inner product loading area 55 in fluid communication with a source of vacuum. The peripheral land areas 57 are illustrated as having one or more apertures 59 formed therethrough adapted to be selectively placed in fluid communication with a source of pressurized fluid, whereby outward fluid flow can emanate from at least a portion of the peripheral land areas 57, as will be described in greater detail below. Such pressurized fluid can comprise any appropriate fluid, however, preferably comprises a gas such as air.

Passageways 58 are illustrated as extending into the interior of mold-depositing core 51 wherein there may be various ducts and channels which lead to a source of vacuum. The manner in which the inner product loading area 55 is placed in fluid communication with a source of vacuum is not critical, and the structure shown and described is meant to simply illustrate a preferred embodiment of such structure. Likewise, apertures 59 may be connected to a series of duct-like channels 61 designed to connect apertures 59 to one or more sources of pressurized fluid. Such internal channels 61 may also be routed through the mold-depositing core 51. It should be understood that channels 61, as well as the vacuum ducts 63, can be designed to selectively place certain apertures 59 or passageway 58 individually in fluid communication with a source of pressurized fluid or vacuum, respectively, as the outer rotatable mold-depositing drum 52 is rotated about mold-depositing core 51 during the product forming procedures.

Compartment-forming surface 53 is preferably designed for rotatable movement about the stationary mold depositing drum 51. Compartment-forming surface 53 may be formed from any reasonably rigid material such that it retains its structural shape after machining, casting or molding. Examples of materials from which a compartment-forming surface 53 may be formed are polyurethane, aluminum, hard rubber, various steel alloys and the like. A large range of dimensions for cavities 56 may also be utilized. For example, if substantially rectangular compartments are desired (as shown), the individual inner product loading areas 55 might range in dimensions from about 0.5 to about 3 inches (between about 13 mm and about 76 mm) or more square. The dimensions of the peripheral land areas 57 may also be varied according to the particular application, depending upon overall compartment size and desired land area requirements. For example, for the substantially rectangular inner product loading areas 55 having outer side dimensions of between about 13 mm and about 76 mm, peripheral land areas 57 having a width of approximately 0.125 inches (about 3.17 mm) might be utilized. Depth of cavities 56 may also vary according to specific compartment dimension requirements. Overall diameter of mold-depositing core 51 and outer compartment-forming surface 53 can also be varied widely in accordance with desired production speeds, individual compartment sizes, overall laminated product dimensions, and the like.

As mentioned, many different arrangements for internal ducting of the vacuum and pressurized fluid may be used, including internal plenum chambers or similar ducting arrangements known in the industry. As will be described in greater detail below, whatever ducting system is utilized must have the capabilities of selectively placing the inner product loading area 55 in fluid communication with a source of vacuum such that suction can be selectively applied to the cavity desired. Likewise, the apertures 59 of the peripheral land areas 57 must be adapted to be selectively placed in fluid communication with a source of pressurized fluid such that outward fluid flow (e.g., air) can emanate when desired from at least a portion of the peripheral land areas. It should also be understood that while the apparatus and process of the subject invention is described most preferably as a rotatable structure, the compartment-forming surface 53 could also be a substantially flat surface designed for use in a reciprocating-type apparatus or in a manual forming process. In such case, compartment-forming surface 53 could be formed as a stationary structure or as a portable structure, as desired. Additionally, although it is preferred that the compartment-forming surface 53 be formed as a substantially tubular-shaped structure having a plurality of inner product loading areas 55 located adjacent one another and being completely surrounded and separated from adjacent loading areas by the peripheral land areas 57, it is also contemplated that an individual inner product loading area 55 surrounded by land areas 57 could equally facilitate the manufacture of porous laminated sheet products having a single compartment formed therein containing a predetermined quantity of inner product. For economy and efficiency, however, a compartment-forming surface comprising a plurality of inner product loading areas 55 formed about a substantially tubular shaped structure to create a rotatable continuous pattern compartment-forming surface is preferred.

Turning now to the process illustrated in FIG. 1 in greater detail, a first web of porous material 15 is supplied from an unwind roll 21, and tension on web 15 is maintained by a simple dancer-type tension control system common to the industry. An example of such a tension control system is illustrated as including tension rolls 22 through 24, and continuous web 15 weaves through these rolls as it is moved toward compartment-forming apparatus 50. Web 15 can be a variety of foramenous materials commonly available in the industry such as paper, perforated thermoplastic material, cloth, and the like; however, the web must be relatively porous and it is preferred that it have multidirectional strength and stretch in order to allow the product to be formed on the apparatus without web failure. Various paper webs which can be utilized in the subject process are described in the commonly assigned U.S. patent application Ser. No. 675,804, filed Nov. 28, 1984, by William T. Bedenk and Kendall L. Hardin and entitled Laminated Laundry Product, said patent application being hereby incorporated herein by reference.

First porous web 15 is brought into contact with the upper surface of compartment-forming surface 53. Because compartment-forming surface 53 is to be formed with one or more cavities 56, it is preferred that first porous web 15 be deformed in a manner corresponding to the contours of compartment-forming surface 53. Such deformation may taken place prior to, simultaneous with, or after first porous web 15 is brought into contact with compartment-forming surface 53. FIG. 1 illustrates an embodiment wherein first porous web 15 is embossed by a male embossing roll 75 after it is brought into contact with the compartment-forming surface 53. Embossing roll 75 may be knobbed in a manner corresponding to the contours of compartment-forming surface 53, or alternatively may simply be a soft rubber roll which forces web 15 into the relieved areas of surface 53. The exact manner of deforming web 15 is not critical, and in some circumstances might be accomplished simply by applying a sufficient vacuum force to the web 15 after it is brought into contact with surface 53 to pull portions of web 15 into the relieved areas thereof. Weight of deposited product in relieved areas may also help to complete this embossing process. Turning roll 25 is illustrated only as an example of a means for bringing the first porous web 15 into contact with compartment-forming surface 53.

To facilitate the web deforming procedures, it is also contemplated that web gathering equipment (not shown) might advantageously be incorporated to provide "slack" in the web in the machine and/or cross-machine direction. Such web gathering equipment is commonly available in the industry and may be more desirable when porous web 15 is not easily deformable otherwise, or if web 15 if relatively easily punctured or perforated.

It is contemplated that compartment-forming surface 53 will be continuously rotated in a clockwise direction so that, as illustrated in FIG. 1, web 15 will be rotated beneath the feeder device 84 where a predetermined quantity of inner product P can be deposited on the upper surface thereof. In this regard, it is highly preferable that cavity 56 of inner product loading area 55 be placed in fluid communication with a vacuum source prior to the deposition of inner product P. Product P can be any product which is desired to be placed within a laminate sheet product and which can free-fall or be entrained in air or fluidized so that it behaves much like a liquid during deposition procedures (such free-falling product shall be hereinafter referred to as "fluidized" product for simplicity). It is important that product P can behave like a liquid or fluid so that the combination vacuum and fluid pressure deposition control system of the subject invention can be most advantageously utilized. In this regard, product P is preferably a fibrous material or a comminuted or granular material. Another advantage of the present invention is that granular material having a "sticky" or adhesive nature can conveniently be handled by this unique vacuum and fluid pressure deposition control system.

Figure 5:
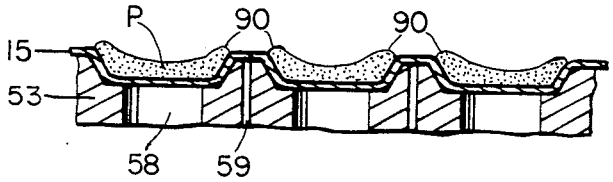
FIG. 5 illustrates the compartment-forming surface of FIG. 4 after quantities of inner product have been deposited on the upper surface of the first porous web.

As illustrated in FIG. 1, product P is supplied to compartment-forming apparatus 50 from hopper 80. In particular, from hopper 80 it is contemplated that product P may be uniformly transported to a feeder device 84 via a conveying or metering device 82. Conveying device 82 can be any of a number of commonly available conveying devices such as a vibrating conveyor, conveyor belt, or the like. Conveying device 82 may help prepare product P (e.g. by separating individual fibers or granules) so that it can behave substantially like fluid within feeder device 84 prior to its deposition on the upper surface of porous web 15. The fluidized product P falls through feeder device 84 and is deposited on the upper surface of the web 15. During such deposition procedure, cavities 56 must be in fluid communication with a vacuum source, and apertures 59 must be placed in fluid communication with a source of pressurized fluid. The porous web 15 acts as a filter to collect the fluidized product as the vacuum pulls it into cavity 56. Product P builds up as a substantially uniform layer within a cavity 56, as best shown in FIG. 5.

It is contemplated that passageways 58 should be of sufficient size to enable a relatively large volume of air to pass inwardly therethrough than the total volume of air passing outwardly through apertures 59. This relationship is important because when it is insured that the net force through the system is in an inward direction, the net force of the web 15 will be inwardly, thereby holding the web against compartment-forming surface 53 during the product deposition and lamination procedures, as described herein. Additionally, this inward net air flow helps to insure that the product deposition procedure is performed in a slight vacuum thereby controlling product P dust and minimizing potential waste of product P which might result therefrom if product P dust were to escape from the system into the ambient air. The fluidized or airborne product P is "rained" or sprinkled onto the upper surface of web 15 at a predetermined rate via feeder device 82 and entry chute 84, and the vacuum source tends to attract the airborne product P to cavities 56 while the pressurized fluid (e.g. air) emanating from apertures 59 tends to repel the airborn product from peripheral land areas 57. The exact pressures of the vacuum and pressurized fluid sources are not critical and may vary according to the physical characteristics of product P being deposited, amount of product to be deposited, rotational speed of compartment-forming surfacing 53, and other related factors. It is important to remember that the vacuum and gravity must create sufficient holding power through web 15 to attract and hold the deposited product P against its upper surface, and to overcome the resultant centrifugal forces created by the rotational movement of the forming surface 53 and the deposited product P. Fluid pressure emanating from land areas 57 must be sufficient to overcome gravity forces and adhesive characteristics of product P which is deposited over such land areas from entry chute 84. For example, it has been found that for square cavities which are nominally 1.5 inches (about 38 mm) on a side, and for a product P having a range of granular size between about 100 and about 1000 microns, passageways 58 should be approximately $\frac{3}{8}$ inches in diameter, and fluid and vacuum pressures can preferably range between about 12 and about 20 inches (between about 305 and about 508 mm) of water.

For the continuous forming process illustrated in FIG. 1, it is contemplated that the stream of product P can be continuously and uniformly deposited via a feeder device 84. It is contemplated that product P might be dosed through feeder device 84 in either a gravimetric or volumetric manner (e.g. feedback monitoring systems might be used to control product deposition by weight). Additionally, if more than one product P is to be supplied, such individual products may be independently controlled and synchronized with either the rotational speed of forming surface 53 or the desired weight of finished product 18.

Because of the fluid pressure emanating from peripheral land areas 57, product P may be deposited uniformly over compartment-forming surface 53 in applications where a single product P is being deposited. This fact facilitates product deposition because no fancy patterns or method of precisely depositing the product in particular areas is needed. Fluid pressure emanating from apertures 59 continuously and automatically maintains peripheral land areas 57 substantially free of deposited product. It has been found, however, that if the cross-machine direction width of product P streams being deposited within product loading areas 55 is limited to a width less than the cross-machine width of cavities 56 into which product P is being deposited, fluid pressure emanating from apertures 59 located along the machine-direction land areas 57 can be minimized or even eliminated. It is preferred, however, to supply pressurized fluid in both the machine and cross-machine directions to insure the relative deposit-free cleanliness of land areas 57 without a need for precise product deposition control. While the width of land areas 57 may be varied according to the particular forming surface details (as mentioned above), it has been found that maintenance of substantially deposit-free lands during deposition of product is best assured by making lands 57 at least 0.125 inches (3.17 mm) in width. This minimum width allows the outwardly flowing fluid pressure to create a "tunnel" along the length of the land areas 57 and insures sufficient outward flow of pressurized fluid through web 15 therealong to maintain the lands substantially free of deposited product.

As mentioned, a wide variety of materials may be deposited as inner product P utilizing the process of the subject invention. For example, inner product P may comprise granulated tea or coffee particles, granulated soap particles, cotton or paper fibers, super absorbent materials, or any other product which can behave substantially like a fluid, as described above. Products having lesser densities may require additional vacuum flow to ensure the prompt settling and compaction of such product within cavities 56 during the product deposition procedure, and to overcome centrifical forces resulting from the rotational movement of the apparatus and deposited product P. This unique combination of vacuum and fluid pressure deposition enables the continuous manufacture of porous laminated sheet products having one or more compartments containing a predetermined quantity of inner product therewithin at speeds much faster than were possible heretofore.

Figure 4:
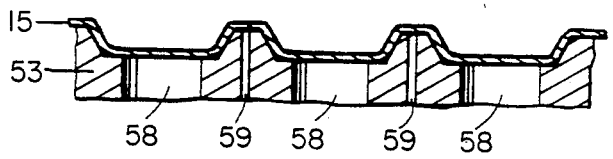
FIG. 4 shows a partial cross-sectional view of the compartment-forming surface of the subject invention having a first porous web of material in contact with the upper surface thereof.

FIG. 4 illustrates a cross-sectional view of a portion of compartment-forming surface 53 after first porous web 15 has been brought into contact therewith and deformed in a manner corresponding to cavities 56 thereof. FIG. 5 illustrates the same portion of compartment-forming surface 53 as illustrated in FIG. 4, after product P has been deposited on the upper surface of web 15. As illustrated the vacuum communicating with cavities 56 via passageways 58 has attracted product P to within cavities 56, while pressurized fluid emanating from apertures 59 has tended to repel product P from being deposited on the upper surfaces of web 15 over peripheral land areas 57. As is also apparent, however, it has been found that the deposited product P within cavities 56 extends upwardly slightly in the areas adjacent peripheral land areas 57 forming peripheral high spots 90. While such peripheral high spots 90 generally do not interfere with further manufacturing procedures, it is preferred that they be reduced somewhat prior to lamination procedures, especially where the upper laminate is to be a flat and/or non-stretchable sheet. As shown in FIG. 1, after product P has been deposited on the upper surface of web 15, the web and its filled cavities are rotated beneath a doctoring mechanism 70 to reduce the peripheral high spots 90 prior to lamination of the second web to the upper surface of web 15.

Figure 6:
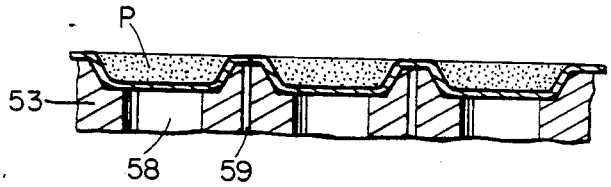
FIG. 6 illustrates the compartment-forming surface of FIG. 5 after high spots in the deposited product have been eliminated.

FIG. 6 illustrates the portion of compartment-forming surface 53 as shown in FIG. 5 after peripheral high spots 90 have been substantially eliminated by the doctoring mechanism. Doctoring mechanism 70 can comprise any means which could perform the necessary doctoring function; for example a blade, brush or air knife. It has been found that a substantially soft brush structure which need not necessarily touch the upper surface of web 15 over the peripheral land 57 performs adequately. This doctoring step should be completed while the vacuum is communicating with cavities 56 and pressurized fluid is emanating from apertures 59 to facilitate confining product P to cavities 56 as desired.

Whether or not the doctoring step is undertaken, compartment-forming surface 53 continues to rotate in a clockwise direction and a second web of material is supplied and laminated to the upper surface of porous web 15 along the peripheral land areas 57 thereby forming one or more porous compartments sealed about their periphery. As illustrated, upper web 16 is supplied from an unwind roll 31 and moves through a standard dancer-type tension control system (rolls 32 through 34). FIG. 1 illustrates an adhesive printing system comprising an adhesive print roll 41, a corresponding pressure roll 42, an adhesive supply reservoir 44, and adhesive 43. It is contemplated that such adhesive 43 may be pattern printed (such as by a gravure type adhesive printing system) or generally applied to the surface of web 16 which is to be laminated to the upper surface of lower porous web 15. The method of laminating upper web 16 to lower web 15 is not critical and may be accomplished by any of the various laminating methods known in the industry. For example, such lamination can be achieved by adhesives (as illustrated), heat seal bonding, pressure sensitive bonding, high pressure bonding such as knurling, and the like. In this regard, the pressurized fluid emanating from the peripheral land areas 57 might be heated or include steam or the like to facilitate a heat seal or knurling bonding process.

Upper web 16 is then brought into a path of travel tangent to the outer periphery of forming surface 53 and laminated to the upper surface of lower web 15 along peripheral land areas 57, thereby forming one or more compartments or pouches within the laminated sheet product. FIG. 1 shows lamination roll 36 as an example of a means to accomplish such lamination. Lamination roll 36 might be a male embossing-type laminator, or simply a soft pressure roll. It has been found that upper web 16 should be brought into a path tangential to forming surface 53 at some distance from surface 53 to minimize entraneous air currents which might be established if web 16 were turned around a turning roll near surface 53. FIG. 1 shows turning roll 35 as being located somewhat remotely from forming surface 53 to insure that any such extraneous air currents will not affect product deposited on the upper surface of web 15 prior to lamination with web 16. Once this lamination has been completed, the vacuum and pressurized fluid can be eliminated from acting upon the laminated sheet product. Thereafter the finished laminated sheet product 18 is removed from the compartment-forming apparatus (e.g. by turning roll 37) for further processing and/or packaging, as desired.

Figure 7:
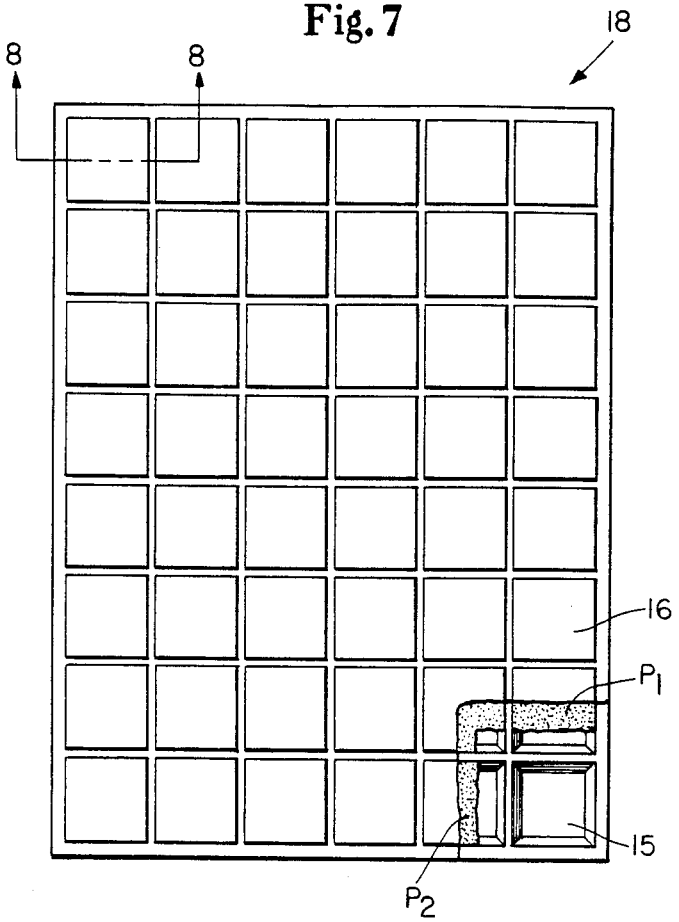
FIG. 7 is a partially broken away top plan view of a porous laminated sheet product formed using the method and apparatus of the subject invention.

FIG. 7 illustrates a plan view of an embodiment of a finished laminated sheet product 18 which has been partially broken away to show the detail of upper web 16, product P held within the discreet compartments of product 18, and lower porous web 15. FIG. 7 also illustrates laminated sheet product 18 as including more than one product P ($P_1$ and $P_2$) discretely compartmentalized therewithin.

Figure 8:
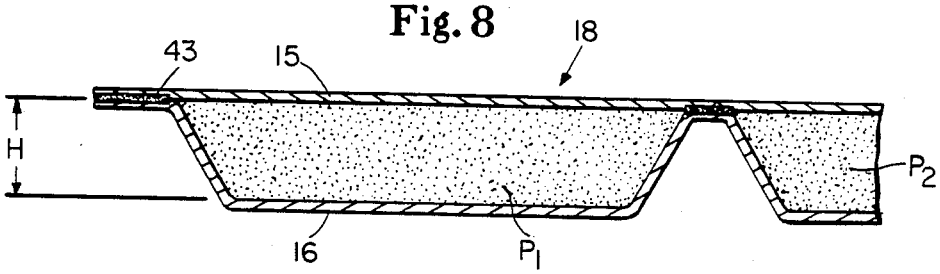
FIG. 8 is a cross-sectional view of a portion of the laminated sheet product of FIG. 7 taken along lines 8—8 thereof.
Figure 9:
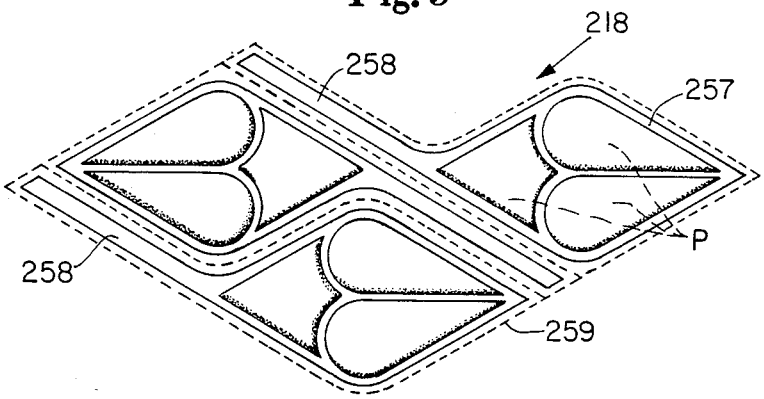
FIG. 9 illustrates an alternate embodiment of a porous laminated sheet product formed using the method and apparatus of the subject invention.

FIG. 8 illustrates a cross-sectional view of a portion of the finished laminated sheet product 18 of FIG. 7 which might be manufactured from the process and on the apparatus of the subject invention. Height H of product 18 substantially corresponds to the depth of the forming cavity in the forming surface as described. FIG. 9 illustrates a portion of an embodiment of another laminated sheet product 218 illustrating an alternate shape of the individual compartments therewithin. In particular, FIG. 9 illustrates a contemplated pouch product which might be used to form individual tea bags and the like on a high speed process and apparatus of the subject invention. As illustrated, peripheral land areas formed in a pouch forming surface of the subject apparatus and method can be utilized to provide not only substantially deposit-free peripheral areas for connecting the upper and lower webs about the deposited product, but also to similarly provide predesignated areas free of deposited product which can be used for other pouch features such as simulating a tea leaf stem 258. Tea leaf stem 258 could be conveniently created by pattern printing of appropriate adhesive as part of the lamination procedure for sheet product 218 to form a relatively rigid handle or "stirrer" for tea bags. Perforations 259 might also be provided in laminated sheet product 218 to facilitate the separation of individual tea leaf pouches.

Figure 3:
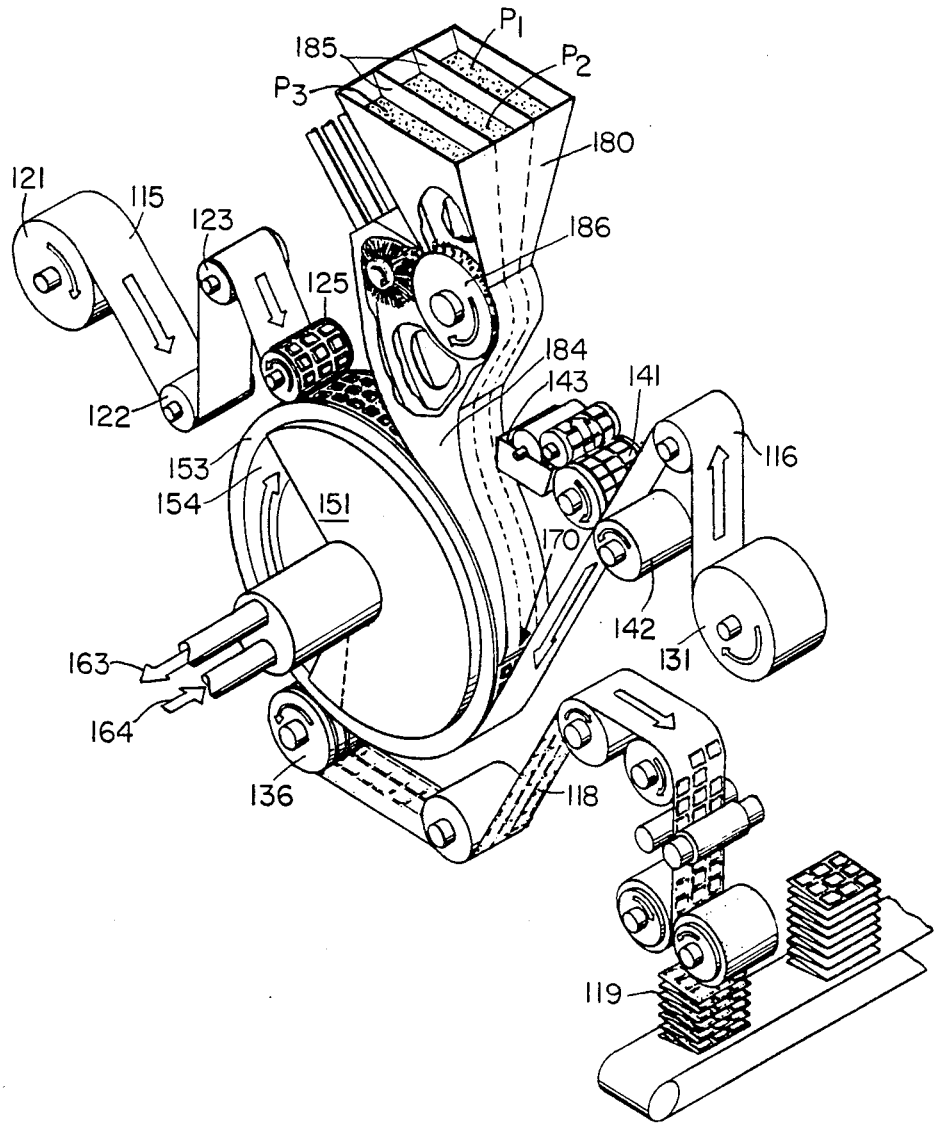
FIG. 3 is a perspective view of a preferred embodiment of an apparatus for making a porous laminated sheet product of the subject invention.

FIG. 3 illustrates a pictorial perspective view of a particularly preferred example of the process and apparatus described herein for manufacturing pouches having upper and lower web members connected about their periphery and containing a predetermined dose of granular product. In particular, the apparatus of FIG. 3 includes the deposition of three separate products (P1, P2 and P3, respectively) into three rows of pouches to be formed in seriatim within a single laminated sheet product. Corresponding to the process as described above, a porous lower web 115 is brought into contact with the outer periphery of pouch-forming surface 153. A male embossing drum 125 embosses lower porous web 115 as it is brought into contact with pouch-forming surface 153. As mentioned earlier with regard to embossing roll 75, a male embossing roll is not critical, and use of a soft rubber roll could equally be utilized, or lower web 115 could be formed in a manner corresponding to the contours of pouch-forming surface 153 prior to being brought into contact therewith. Pouch-forming surface 153 is formed in a manner substantially identical to compartment-forming surface 53 illustrated in FIG. 2 and described above. It is preferred that the vacuum and pressurized fluid sources (shown as 163 and 164, respectively) be brought into fluid communication with the cavities and apertures of pouch-forming surface 153 as lower web 115 is brought into contact therewith to facilitate holding the web against surface 153 at it is rotated.

As illustrated, hopper 180 includes two product dividers 185 which separate the respective products P1, P2 and P3 as they are conveyed toward the feeder chute 184 for deposition on the upper surface of lower web 115. Rotating fluidizer 186 is shown as an example of a way in which the respective products might be made "airborne" or fluidized as they are fed into feeder chute 184. It is contemplated that dividers 185 might extend throughout hopper 180, fluidizer 186 and feeder chute 184 to maintain the separation of the products throughout the deposition procedure. It is also contemplated that fluidizer 186 might combine features of standard volumetric and/or gravimetric feeders to precisely and accurately control independently the deposited quantity of products P1, P2 and P3, respectively, during the deposition process. Feeder chute 184 is shown as having a slight curve corresponding to the outer surface of pouch-forming surface 153 in order to provide the free-falling or fluidized products with a velocity component similar to that of rotating pouch-forming surface 153. Overall velocity of products to be deposited may be varied by precisely designing the vertical height and shape of feeder chute 184.

While dividers 185 may be used to maintain separation of the individual products prior to deposition on the upper surface of lower web 115 in a predetermined pattern, if several of the products are incompatible with one another, it might also be desirable to increase the width of the peripheral land areas of pouch-forming surface 153 in the machine direction and/or add additional apertures and/or increase the fluid pressure emanating therefrom. Any of these variables may be adjusted to insure that such incompatible products remain isolated from one another. The lowermost edge of feeder chute 184 may be formed as a doctor mechanism 170 to reduce peripheral high spots in the product deposited within the individual cavities of pouch-forming surface 153, as described above.

A second web 116 of pouch-forming material is supplied via unwind roll 131 and pattern printed with an appropriate adhesive 143 as it passes between the gravure-type adhesive printing roll 141 and pressure roll 142. Second web 116 is then tangentially brought into contact with the upper surface of first porous web 115 and laminated thereto along the peripheral land areas, thereby forming a laminated sheet product 118 comprising a plurality of pouches containing products P1, P2 and P3. The laminated sheet product 118 may thereafter be cut into individual products 119, as desired.

It is contemplated that the number and size of individual compartments within a laminated sheet product made in accordance herewith may be varied as desired to accommodate a number of different products and/or different product volumes within a single compartmentalized laminated sheet product. Additionally, a plurality of similar vacuum and pressurized fluid product deposition systems, as described, could be combined in the process to achieve multi-stage or successive product deposition prior to lamination procedures.

Having shown and described the preferred embodiment of the present invention, further adaptions of the method and apparatus described herein can be accomplished by appropriate modifications by one of ordinary skill in the art without departing from the scope of the present invention. Accordingly, the scope of the present invention should be considered in terms of the following claims, and is understood not to be limited to the details of structure and operation shown and described in the specification and drawings.

I claim:

1. An apparatus for making a porous laminated sheet product having upper and lower web members connected about their periphery and having at least one compartment formed therein, and containing a predetermined quantity of inner product within said compartment, at least one of said web members being porous, and said apparatus comprising:

(a) a compartment-forming surface having at least one inner product loading area formed therein which further comprises a cavity surrounded by peripheral land areas;

(b) means to place a lower porous web in contact with said compartment-forming surface such that said lower porous web overlies said cavity and said peripheral land areas;

(c) a passageway, means to selectively place said inner product loading area cavity in fluid communication with a source of vacuum such that suction can be selectively applied to said cavity; and (d) said peripheral land areas having one or more apertures formed therethrough, a source of pressurized fluid, means to selectively place said one or more apertures in fluid communication with said source of pressurized fluid whereby outward fluid flow emanates from at least a portion of said peripheral land areas such that the vacuum acting through the lower porous web holds the inner product within the portions of the lower porous web which overlie the cavity and the pressurized fluid acting through the lower porous web keeps the inner product from being deposited on the portions of the lower porous web which overlie the peripheral land areas.

2. The apparatus of claim 1, wherein said compartment-forming surface comprises a plurality of inner product loading areas located adjacent one another, each product loading area being surrounded and separated from adjacent inner product loading areas by said peripheral land areas.

3. The apparatus of claim 2, wherein said compartment-forming surface comprises a substantially tubular-shaped structure having said inner product loading areas and peripheral land areas formed on the outer surface thereof to thereby create a rotatable continuous pattern compartment-forming surface thereabout.

4. The apparatus of claim 3, wherein said product loading area cavities are adapted for said fluid communication with a common vacuum source.

5. The apparatus of claim 4, wherein said apertures of said peripheral land areas are adapted for said fluid communication with a common source of pressurized fluid.

6. The apparatus of claim 5, wherein said peripheral land areas have a plurality of said apertures formed therethrough adapted to be selectively placed in fluid communication with a source of pressurized fluid such that outward fluid flow can emanate therefrom along substantially the entire length of said peripheral land areas.

7. The apparatus of claim 1, wherein said apparatus is designed for making porous pouches having upper and lower web members connected about their periphery and containing a predetermined dose of granular product, said compartment-forming surface correspondingly designed as a pouch-forming surface having at least one granular product loading area formed therein.

8. An apparatus for making laminated porous pouches having upper and lower web members connected about their periphery and containing a predetermined dose of granular product, at least one of said web members being porous, and said apparatus comprising:

(a) a pouch-forming surface having product loading area formed therein which further comprises a cavity surrounded by peripheral land areas;

(b) means to place a lower porous web in contact with said pouch-forming surface such that said lower porous web overlies said cavity and said peripheral land areas.

(c) said cavity having a passageway, means to selectively place said product loading area cavity in fluid communication with a source of vacuum such that suction can be selectively applied to said cavity; and (d) said peripheral land areas having one or more apertures formed therethrough, a source of pressurized fluid, means to selectively place said one or more apertures in fluid communication with said source of pressurized fluid whereby outward fluid flow emanates from at least a portion of said peripheral land areas such that the said vacuum acting through the lower porous web holds the granular product within the portions of the lower porous web which overlie the cavity and the pressurized fluid acting through the lower porous web keeps the granular product from being deposited on the portions of the lower porous web which overlie said peripheral land areas.

9. The apparatus of claim 8, wherein said pouch-forming surface comprises a plurality of inner product loading areas located adjacent one another, each inner product loading area being surrounded and separated from adjacent inner product loading areas by said peripheral land areas.

10. The apparatus of claim 9, wherein said pouch-forming surface comprises a substantially tubular-shaped pouch-forming structure having said product loading areas and peripheral land areas formed on the outer surface thereof to thereby create a rotatable continuous pattern pouch-forming surface thereabout.

11. The apparatus of claim 10, wherein said product loading area cavities are adapted for said fluid communication with a common vacuum source.

12. The apparatus of claim 11, wherein said apertures of said peripheral land areas are adapted for said fluid communication with a common source of pressurized fluid.

13. The apparatus of claim 12, wherein said peripheral land areas have a plurality of said apertures formed therethrough adapted to be selectively placed in fluid communication with a source of pressurized fluid such that outward fluid flow can emanate therefrom along substantially the entire length of said peripheral land areas.

14. The apparatus of claim 12, wherein said peripheral land areas have a plurality of said apertures formed therethrough adapted to be selectively placed in fluid communication with a source of pressurized fluid such that outward fluid flow can emanate therefrom along only those peripheral land areas oriented in the cross-machine direction relative to the rotation of said pouch-forming surface.

15. An apparatus for making porous pouches having upper and lower web members connected about their periphery and containing a predetermined dose of granular product, at least one of said web members being porous, and said apparatus comprising:

(a) a pouch-forming surface having a plurality of product loading areas formed therein, each such product loading area further comprising a cavity surrounded by peripheral land areas;

(b) means to place a porous web in contact with said pouch-forming surface such that said porous web overlies said cavities and said peripheral land areas;

(c) a passageway connected to the lower portion of each of said cavities, means to selectively place said product loading area cavities in fluid communication with a source of vacuum such that suction can be selectively applied to said cavities; and (d) said peripheral land areas having a plurality apertures formed therethrough, a source of pressurized fluid, means to selectively place said apertures. in fluid communication with said source of pressurized fluid, whereby outward fluid flow emanates from at least a portion of said peripheral land areas such that the vacuum acting through said porous web holds the granular product within the portions of the porous web which overlie said cavities and the pressurized fluid acting through said porous web keeps the granular product from being deposited on the portions of the porous web which overlie said peripheral land areas.

16. The apparatus of claim 15, wherein said product loading areas are located adjacent one another, each product loading area being surrounded and separated from adjacent product loading areas by said peripheral land areas.

17. The apparatus of claim 16, wherein said pouch-forming surface comprises a substantially tubular-shaped cylindrical structure having said product loading areas and peripheral land areas formed on the outer surface thereof to thereby create a rotatable continuous pattern pouch-forming surface thereabout.

18. The apparatus of claim 17, wherein said product loading area cavities are adapted for said fluid communication with a common vacuum source.

19. The apparatus of claim 18, wherein said apertures of said peripheral land areas are adapted for said fluid communication with a common source of pressurized fluid.

20. The apparatus of claim 19, wherein said apertures are adapted to be selectively placed in fluid communication with a source of pressurized gas such that outward air flow can emanate therefrom along substantially the entire length of said peripheral lands.

21. The apparatus of claim 20 wherein said passageway is connected to the lower portion of said cavity and comprises a single vacuum channel connected to a vacuum source.

22. The apparatus of claim 21, wherein said single passageway in centrally located at the bottom of said cavity.

23. An apparatus for continuously making porous pouches having upper and lower web members connected about the periphery of each pouch, at least one of said web members being porous, said pouches each containing a predetermined quantity of granular product, said apparatus comprising:

(a) means to continuously supply said upper and lower web members;

(b) a rotatable substantially tubular-shaped pouch-forming structure having a pouch-forming surface formed about its outer periphery, said pouch-forming surface having a plurality of product loading areas formed therein and spaced adjacent one another, each said product loading area further comprising a cavity surrounded by peripheral land areas;

(c) means to place a lower porous web in contact with said pouch-forming surface such that lower porous web overlies said cavities and said land areas;

(d) said cavity having a passageway connected to each of said cavities means, to selectively place said product loading area cavity in fluid communication with a source of vacuum such that suction can be selectively applied thereto;

(e) said peripheral land areas surrounding and separating said product loading areas from each other and having a plurality of apertures formed therethrough, a source of pressurized fluid, means to selectively place said apertures in fluid communication with said source of pressurized gas whereby outward air flow emanates from at least a portion of said peripheral land areas;

(f) means to supply granular product for selective deposition on said lower web member when said lower web member is in contact with said pouch-forming surface such that the vacuum acting through the lower porous web holds the granular product within the portions of the lower porous web which overlie the cavities and the pressurized fluid acting through the lower porous web keeps the inner product from being deposited on the portions of the lower porous web which overlie the peripheral land areas; and (g) means to laminate said upper web member to said lower web member.

24. The apparatus of claim 23, wherein each of said cavities is connected by a single vacuum channel to a source of vacuum.

25. The apparatus of claim 24, wherein each of said single vacuum channels is centrally located at the bottom of the respective cavities.

26. The apparatus of claim 25, wherein said loading area cavities are adapted for said fluid communication with a common vacuum source.

27. The apparatus of claim 26, wherein said apertures of said peripheral land areas are adapted for said fluid communication with a common source of pressurized gas.

28. The apparatus of claim 27, wherein said apertures are adapted to be selectively placed in fluid communication with said source of pressurized gas such that outward air flow can emanate therefrom along substantially the entire length of said peripheral lands.

29. An apparatus for continuously making porous pouches having upper and lower porous web members connected about the periphery of each pouch, said pouches each containing a predetermined quantity of granular product, said apparatus comprising:

(a) means to continuously supply said upper and lower porous web members;

(b) a rotatable substantially tubular-shaped pouch-forming structure having a pouch-forming surface formed about its outer periphery, said pouch-forming surface having a plurality of product loading areas formed therein and spaced adjacent one another, said product loading areas further comprising a cavity surrounded by peripheral land areas;

(c) means to place a lower porous web in contact with said pouch-forming surface such that said lower porous web overlies said cavity and said land areas;

(d) said cavity having a passageway connected to each of said cavities, means to selectively place said product loading area cavities in fluid communication with a common source of vacuum such that suction can be selectively applied thereto;

(e) said peripheral land areas surrounding and separating said product loading areas from each other and having a plurality of apertures formed therethrough, a source of pressurized fluid, means to selectively place said apertures in fluid communication with said source of pressurized gas whereby outward air flow emanates from substantially the entire peripheral length of said peripheral land areas such that the vacuum acting through the porous lower web holds the granular product within the portions of the lower porous web which overlie the cavities and the pressurized fluid acting through the porous llower web keeps the granular product from being deposited on the portions of the porous lower web which overlie the peripheral land areas;

(f) means to supply granular product for selective deposition on said lower web member when said lower web member is in contact with said pouch-forming surface; and (g) doctor means to prevent excessive deposition of product within said cavities adjacent said peripheral land areas; and (h) means to laminate said upper web member to said lower web member.

30. The apparatus of claim 29, wherein said doctor means comprises a rotating brush-like structure.

31. A process for making a porous laminated sheet product having at least one compartment formed therein and containing a predetermined quantity of inner product within said compartment, said process comprising the following steps:

(a) placing a first porous web of material in contact with a compartment-forming surface, said compartment-forming surface having at least one cavity adapted to be selectively placed in fluid communication with a vacuum source, said cavity being surrounded by peripheral land areas having at least one aperture formed therein adapted to be selectivelyplaced in fluid communication with a source of pressurized fluid whereby outward fluid flow can emanate from at least a portion of said peripheral land areas;

(b) selectively placing said at least one cavity in fluid communication with said vacuum source and selectively placing said at least one aperture in fluid communication with said source of pressurized fluid;

(c) depositing a quantity of inner product on the upper surface of said first porous web such that the vacuum source acting through said first porous web tends to hold said inner product against the upper surface of said first porous web in said cavity, while said pressurized fluid acting through said first porous web tends to keep said inner product from being deposited on the upper surface of first porous web in said peripheral land areas; and (d) supplying a second web of material and laminating the lower surface of said second web to the upper surface of said first porous web along said peripheral land areas, thereby forming one or more porous compartments sealed about their periphery.

32. The process of claim 31, comprising the additional step of deforming said first porous web of material in a manner corresponding to the contours of said compartment-forming surface, said deforming step being completed prior to depositing said granular product on the upper surface thereof.

33. The process product of claim 32, wherein said process is continuous and said first and second webs are supplied from continuous supply rolls.

34. The process of claim 33, wherein said compartment-forming surface is formed on a rotatable, substantially tubular-shaped structure to thereby enable such continuous forming thereon, said first porous web being placed in contact with said forming surface along one portion of such continuous rotation and said inner product being deposited at a subsequent point in such rotation.

35. The process of claim 34, wherein a plurality of inner products are deposited on the upper surface of said first porous web such that the vacuum source tends to hold said products thereagainst in said cavity.

36. The process of claim 35, wherein said compartment-forming surface comprises a plurality of cavities arranged adjacent one another, each cavity being surrounded and separated from adjacent cavities by said peripheral land areas, and wherein said inner products are deposited in a predetermined pattern on said upper surface of said first porous web such that they are held by said vacuum source against said upper surface of the web in predetermined cavities.

37. The process of claim 32, wherein said step of deforming said first porous web of material is completed simultaneously with placing said first porous web in contact with said compartment-forming surface.

38. A process for making porous pouches containing a predetermined quantity of granular product, said process comprising the following steps:

(a) placing a first porous web of pouch material in contact with a pouch forming surface, said pouch forming surface having at least one cavity adapted to be selectively placed in fluid communication with a vacuum source, said cavity being surrounded by peripheral land areas having at least one aperture formed therein adapted to be selectively placed in fluid communication with a source of pressurized fluid whereby outward fluid flow can emanate from at least a portion of said peripheral land areas such that said first porous web overlies said at least one cavity and said peripheral land areas;

(b) selectively placing said at least one cavity in fluid communication with said vacuum source in selectively placing said at least one aperture in fluid communication with said source of pressurized fluid;

(c) depositing a quantity of granular product on the upper surface of said first porous web such that the vacuum source acting through said first porous web tends to hold said granular product against the upper surface of said first porous web in said cavity, while said pressurized fluid acting through said first porous web tends to keep said granular product from being deposited on the upper surface of said first porous web in said peripheral land areas; and (d) supplying a second porous web of pouch material and laminating the lower surface of said second web to the upper surface of said first porous web along said peripheral land areas, thereby forming one or more porous pouches sealed about their periphery.

39. The process of claim 38, comprising the additional step of deforming said first porous web of pouch material in a manner corresponding to the contours of said pouch forming surface, said deforming step being completed prior to depositing said granular product on the upper surface thereof.

40. The process of claim 39, wherein said process is continuous and said first and second porous webs are supplied from continuous supply rolls.

41. The process of claim 40, wherein said forming surface is formed on a rotatable, substantially tubular-shaped structure to thereby enable such continuous pouch forming thereon, said first porous web being placed in contact with said forming surface along one portion of such continuous rotation and said product being deposited at a subsequent point in such rotation.

42. The process of claim 41, wherein a plurality of products are simultaneously deposited on the upper surface of said first porous web such that the vacuum source tends to hold said products thereagainst in said cavity.

43. The process of claim 42, wherein said forming surface comprises a plurality of cavities arranged adjacent one another, each cavity being surrounded and separated from adjacent cavities by said peripheral land areas, and wherein said granular products are individually deposited in a predetermined pattern on said upper surface of said first porous web such that they are held by said vacuum source against said upper surface of the web in predetermined cavities.

44. The process of claim 43, wherein said step of deforming said first porous web of material is completed simultaneously with placing said first porous web in contact with said compartment-forming surface.

45. A continuous process for making porous pouches containing a predetermined dose of granular product, said process comprising the following steps:

(a) placing a first porous web of pouch material in contact with a pouch forming surface, said pouch forming surface formed on the outer periphery of a rotatable, substantially tubular-shaped structure and having at least one cavity adapted to be selectively placed in fluid communication with a vacuum source, said cavity being completely surrounded by peripheral land areas having an aperture formed therein adapted to be selectively placed in fluid communication with a source of pressurized fluid whereby outward fluid flow can emanate from at least a portion of said peripheral land areas;

(b) deforming said first porous web of pouch material in a manner corresponding to the contours of said pouch forming surface;

(c) selectively placing said at least one cavity in fluid communication with said vacuum source and selectively placing said aperture in fluid communication with said source of pressurized fluid;

(d) depositing a quantity of granular product on the upper surface of said first porous web while it is in contact with said pouch forming surface such that the vacuum source acting through said first porous web tends to hold said granular product against the upper surface of said first porous web in said cavity, while said pressurized fluid acting through said first porous web tends to keep said granular product from being deposited on the upper surface of said first porous web in said peripheral land areas; and (e) supplying a second web of pouch material above said first porous web and laminating the lower surface of said second web to the upper surface of said first porous web along said peripheral land area, thereby forming one or more porous pouches sealed about their periphery.

46. The process of claim 45, which further comprises the step of eliminating high spots from said product deposited on the upper surface of said first porous web in said cavity adjacent said peripheral land areas.

47. The process of claim 46, wherein said step of deforming said first porous web is accomplished while said first web is in contact with said pouch forming surface and prior to the step of depositing said granular product thereon.

48. The process of claim 47, wherein said step of deforming said first porous web of material is completed simultaneously with placing said first porous web in contact with said compartment-forming surface.

49. The process of claim 48, wherein said pouch forming surface comprises a plurality of cavities arranged adjacent one another, each cavity being surrounded and separated from adjacent cavities by peripheral land areas, and wherein a plurality of granular products are individually deposited in a predetermined pattern on said upper surface of said first porous web such that they are held by said vacuum source against said upper surface of the web in predetermined cavities.

50. A continuous process for making porous pouches containing a predetermined quantity of granular product, said process comprising the following steps:

(a) placing a first porous web of pouch material in contact with a pouch forming surface, said pouch forming surface formed on the outer periphery of a rotatable, substantially tubular-shaped structure and having a plurality of cavities adapted to be selectively placed in fluid communication with a vacuum source, said cavities being spaced adjacent one another and each being completely surrounded by peripheral land areas having an aperture formed therein adapted to be selectively placed in fluid communication with a source of pressurized gas whereby outward gas flow can emanate from at least a portion of said peripheral land areas;

(b) deforming said first porous web of pouch material in a manner corresponding to the contours of said pouch forming surface;

(c) selectively placing said cavities in fluid communication with said vacuum source and selectively placing said aperture in fluid communication with said source of pressurized fluid;

(d) depositing a quantity of granular product on the upper surface of said first porous web while it is in contact with said pouch forming surface such that the vacuum source acting through said first porous web tends to hold said granular product against the upper surface of said first porous web in said cavities, while said pressurized gas acting through said first porous web tends to keep said granular product from being deposited on the upper surface of said first porous web in said peripheral land areas;

(e) eliminating high spots from said deposited granular product within said cavities adjacent said peripheral land areas;

(f) supplying a second web of porous pouch material above said first porous web and laminating the lower surface of said second web to the upper surface of said first porous web along said peripheral land areas, thereby forming a plurality of adjacent porous pouches sealed about their periphery; and (g) separating said laminated pouches as desired.

51. The process of claim 50, wherein a plurality of granular products are individually deposited in a predetermined pattern on said upper surface of said first porous web such that they are held by said vacuum source against said upper surface of the web in predetermined cavities.

52. The process of claim 51, wherein said plurality of granular products are simultaneously deposited in said predetermined pattern on said upper surface of said first porous web.

53. The process of claim 51, wherein said plurality of granular products are successively deposited in seriatim in a predetermined pattern on said upper surface of said first porous web.

* * * * *

UNITED STATES PATENT OFFICE

CERTIFICATE OF CORRECTION

PATENT NO. : 4,571,924

DATED : Feb. 25, 1986

INVENTOR(S) : Abdul Sattar Bahrani

It is certified that error appears in the above-identified patent and that said Letters Patent are hereby corrected as shown below:

Column 1, line 19, delete "in" and insert therefor -- is -- .

Column 7, line 43, delete "large" and insert therefor -- larger -- .

Column 9, line 4, delete "centrifical" and insert therefor -- centrifugal --.

Column 11, line 29, delete "at" and insert therefor -- as -- .

Column 15, line 44, delete "," after means.

Column 17, line 16, after "areas;" insert -- such that said first porous web overlies said at least one cavity and said peripheral land areas; -- .

Column 17, line 43, delete "product".

Signed and Sealed this

Fourth Day of November, 1986

[SEAL]

*Attest:*

DONALD J. QUIGG

*Attesting Officer*

*Commissioner of Patents and Trademarks*